US009700478B2

(12) United States Patent
Schörgendorfer et al.

(10) Patent No.: US 9,700,478 B2
(45) Date of Patent: Jul. 11, 2017

(54) TRAINING DEVICE FOR HUMAN WALKING MOVEMENT

(71) Applicant: sch.epp OG, Leoben (AT)

(72) Inventors: Martin Schörgendorfer, Graz (AT); Christof Hepp, Dornbirn (AT)

(73) Assignee: Schepp Medtech GmbH, Leoben (AT)

( * ) Notice: Subject to any disclaimer, the term of this patent is extended or adjusted under 35 U.S.C. 154(b) by 479 days.

(21) Appl. No.: 14/306,427

(22) Filed: Jun. 17, 2014

(65) Prior Publication Data

US 2014/0371640 A1 Dec. 18, 2014

(30) Foreign Application Priority Data

Jun. 17, 2013 (EP) ..... 13172279

(51) Int. Cl.
*A61H 15/00* (2006.01)
*A61H 1/02* (2006.01)

(52) U.S. Cl.
CPC ..... *A61H 1/0266* (2013.01); *A61H 1/0262* (2013.01); *A61H 2201/1215* (2013.01); *A61H 2201/1621* (2013.01)

(58) Field of Classification Search
CPC ..... A61H 1/00; A61H 1/02; A61H 1/0262; A61H 1/0266; A61H 2001/027; A61H 2201/00; A61H 2201/12; A61H 2201/1207; A61H 2201/123; A61H 2201/1261; A61H 2201/1418; A61H 2201/1436; A61H 16/164; A61H 16/1642; A61H 16/1676; A61H 2203/00; A61H 2203/0406; A61H 2203/0481; A61H 2203/0487; A61H 2205/00; A61H 2205/12; A61H 2201/1215; A61H 2201/1621
See application file for complete search history.

(56) References Cited

U.S. PATENT DOCUMENTS 3,824,994 A * 7/1974 Soderberg, Sr. ..... A61H 1/0259 482/51
4,862,875 A * 9/1989 Heaton ..... A61H 1/0266 482/79

(Continued)

FOREIGN PATENT DOCUMENTS

DE 19805164 C1 5/1999
DE 102009022560 A1 12/2010

*Primary Examiner* — Steven Douglas
(74) *Attorney, Agent, or Firm* — Panitch Schwarze Belisario & Nadel LLP

(57) ABSTRACT

A walking movement device is provided for producing a walking movement of a human being with two controlled foot guiding units, each having a foot plate for placing a foot thereon. The foot plates are alternately movable forward and backwards in opposite directions to stimulate the walking movement. The foot plates are coupled with at least one drive unit, via which drive unit the walking movement of the foot plates can be produced, and have a suspension unit for easing the weight on the human being. The foot plates each have a front and a rear partial area with the at least one drive unit being configured to move the rear partial area out of the common plane with respect to the front partial area and back again during the walking movement of the foot plates, in order to enable bending of the midfoot toe joint during the movement process.

9 Claims, 6 Drawing Sheets

(56) References Cited

U.S. PATENT DOCUMENTS

| | | | | |
|---|---|---|---|---|
| 2010/0228169 | A1* | 9/2010 | Ootani | A61H 15/00<br>601/118 |
| 2010/0268129 | A1* | 10/2010 | Park | A61H 1/0237<br>601/35 |

* cited by examiner

TRAINING DEVICE FOR HUMAN WALKING MOVEMENT

BACKGROUND OF THE INVENTION

The invention relates to a walking movement device for producing a walking movement of a human comprising two controlled foot guiding units, each comprising a foot plate for placing a foot thereon, the foot plates being alternately movable forward and backwards in opposite directions to stimulate the walking movement, and the foot plates being coupled with at least one drive unit, via which drive unit the walking movement of the foot plates can be produced, and comprising a suspension unit for easing the weight on the human being.

Devices for walking rehabilitation known so far, such as those described in German Patents DE 198 05 164 C1 and DE 10 2009 022 560 B4 have the drawback of an essentially rigid connection of the foot to the holder devices or foot plates designed for the same.

However, in the natural walking movement of humans, there is a bending of the midfoot toe joint (plantar flexion), achieving an angle of up to 70° between the bottom of the foot and the ground. Such bending processes are not allowed by conventional walking movement exercising devices, which can bring about unpleasant restrictions of movement of the ankle joint in the user's feet.

German Patent DE 10 2009 022 560 B4 describes integrated foot plates, wherein the patient's foot permanently rests on a planar resting surface during movement. The drive mechanism comprises a cantilever hinged to a first movable carriage that has a rotatably supported foot plate arranged at its end. The cantilever thus forms a pivoting arm that performs the movement of the foot plate with its end and therefore needs to be implemented as adequately massive. A second movable carriage is provided for supporting the pivoting and linear movements of the cantilever, which performs a relative movement to the first carriage, for which a separate screw drive is required. In addition, a separate belt drive is provided at the cantilever for inclining the foot plate.

BRIEF SUMMARY OF THE INVENTION

It is thus an object of the invention to provide a walking movement device of the kind mentioned above, by which correct walking movement of the person to be trained can be achieved.

Another object of the invention is to produce a walking movement device by which a speed distribution between standing-leg and free-leg phases that is adapted to a human being's natural walking movement can be realized.

Further, for reasons of convenient maintenance and repair of the device to be produced, it is intended to provide a simple drive system for producing all sequences of movement.

It is a further goal of the invention to provide a device for which only one central drive unit is required, which produces both horizontal and vertical movements.

According to an embodiment of the invention, this is achieved by the foot plates each having a front and a rear partial area, the at least one drive unit being configured to move the foot plates of the rear partial area out of the common plane with respect to the front partial area and back again during the walking movement of the foot plates in order to enable bending of the midfoot toe joint during the movement process.

Due to a separation of the foot plate into a front and a rear partial area, the foot can perform the necessary bending of the midfoot toe joint during the movement process and therefore constitute a correct walking movement. The heel is lifted during bending and can perform this movement because of the movability of the rear partial area with respect to the front partial area. The separated foot plane thus allows representing the natural walking movement better than known devices.

According to an embodiment of the invention, the rear end of the front partial area and the front end of the rear partial area of the foot plates can be joined together via a joint, the at least one drive unit being configured to pivot the rear partial area of the foot plates out of the common plane into an angular position with respect to the front partial area and back again during the walking movement of the foot plates.

Formation of the joint between the front and rear partial areas can be performed with very simple technical means, as long as it is ensured that the joint allows an angular position between the front and rear partial areas during the bending phase of the movement.

In order to allow lifting the heel during the bending process of the foot, the foot plate must perform an additional vertical movement during the horizontal movement.

According to another embodiment of the invention, the horizontal movement is superimposed with a vertical movement of the foot plate, and to do so, the at least one drive unit comprises a horizontal drive unit and a vertical drive unit of the foot plate, which are preferably formed independently of each other, the horizontal drive unit of the foot plate comprising a push rod operated via a first eccentric drive unit and a further push rod driven by the push rod and coupled to the foot plate at its operating end.

The horizontal drive unit can be via an engine, which drives the first eccentric drive unit and via the latter also the push rod, whose movement is redirected to a linear movement via the further push rod. The center of the rotating movement can be arranged at a variable distance from the path of the linear movement, whereby differential speed distribution between the forward and backwards movements can be realized. This allows the separation between standing-leg and free-leg phases to be freely pre-selectable to a certain extent.

Another embodiment of the invention can be that the vertical drive unit comprises a second eccentric drive unit and a pivotable beam coupled thereto and pivotable between a horizontal and an inclined position, a glidingly or rollingly supported guide carriage being arranged on the beam, to which the operating end of the further push rod is coupled, and the guide carriage itself being connected to the rear end of the rear partial area of the foot plate via a joint.

In this way, the horizontal and vertical movements can superimpose each other, and the foot plate can perform both the forward and backwards movements and the bending movement.

As only about one third of each stepping period requires a lifted position of the heel, the vertical drive unit is intended to represent this temporal division as well, and this is intended to be derived from the circular actuating movement, which can be performed, according to another embodiment of the invention, by the second eccentric drive unit comprising a first eccentric arm and a second eccentric arm driven by the first one, the second eccentric arm rotating at an angular speed that is twice that of the first eccentric arm. The superimposed movement of the first and second eccentric arms results in the desired separation of lifting and lowering phases of the rear partial area of the foot plate.

The foot plate is intended to be guided such that the foot, upon forward movement of the foot, swings off in the form of a circular arc without being bent, while the tip of the foot is slightly lifted.

According to another embodiment of the invention, the front end of the rear partial area of the foot plate can have rollers, which unroll on ramp lanes, which are composed of a rear horizontal section and a front ascending section.

In order to support the front partial area for the horizontal portion of the movement, another embodiment of the invention can provide that the front end of the front partial area of the foot plate has rollers, which unroll on a horizontal section of a frame portion, the front partial area of the foot plate being moved with the rear partial area at an angle with respect to the horizontal upon movement of the rear partial area of the foot plate along the linearly ascending section and the rollers of the front partial area being lifted from the horizontal section of the frame portion while the reels of the rear partial area roll up the ramp lanes.

Prolonged maintenance intervals and convenient construction designs can be achieved if, according to another embodiment of the invention, the horizontal drive unit and the vertical drive unit, preferably for both legs, can be actuated via a common engine, for example, using a layshaft and chains. Even when both legs are actuated, a 60:40 distribution between the standing-leg and the free-leg phases can be maintained.

In this context, the horizontal drive unit and the vertical drive unit can be implemented separately, and an uneven time distribution between the standing-leg and the free-leg phases can be realized. Still, the drive engine for the device can be operated at a constant angular speed, which allows for coupling of both foot plates.

Instead of the chain, an equally functional element for skilled persons, such as a belt or a spur gear, can also be used.

Further, the suspension unit can comprise a controllable crane arm and be horizontally movable in order to carry the human being in and/or out.

Another embodiment of the invention can be that the foot plates are coupled to a vibration unit, which generates a vibration of the foot plates. By vibration in the foot plate, additional stimulation is made possible, selectively in the standing-leg phase and/or in the free-leg phase.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
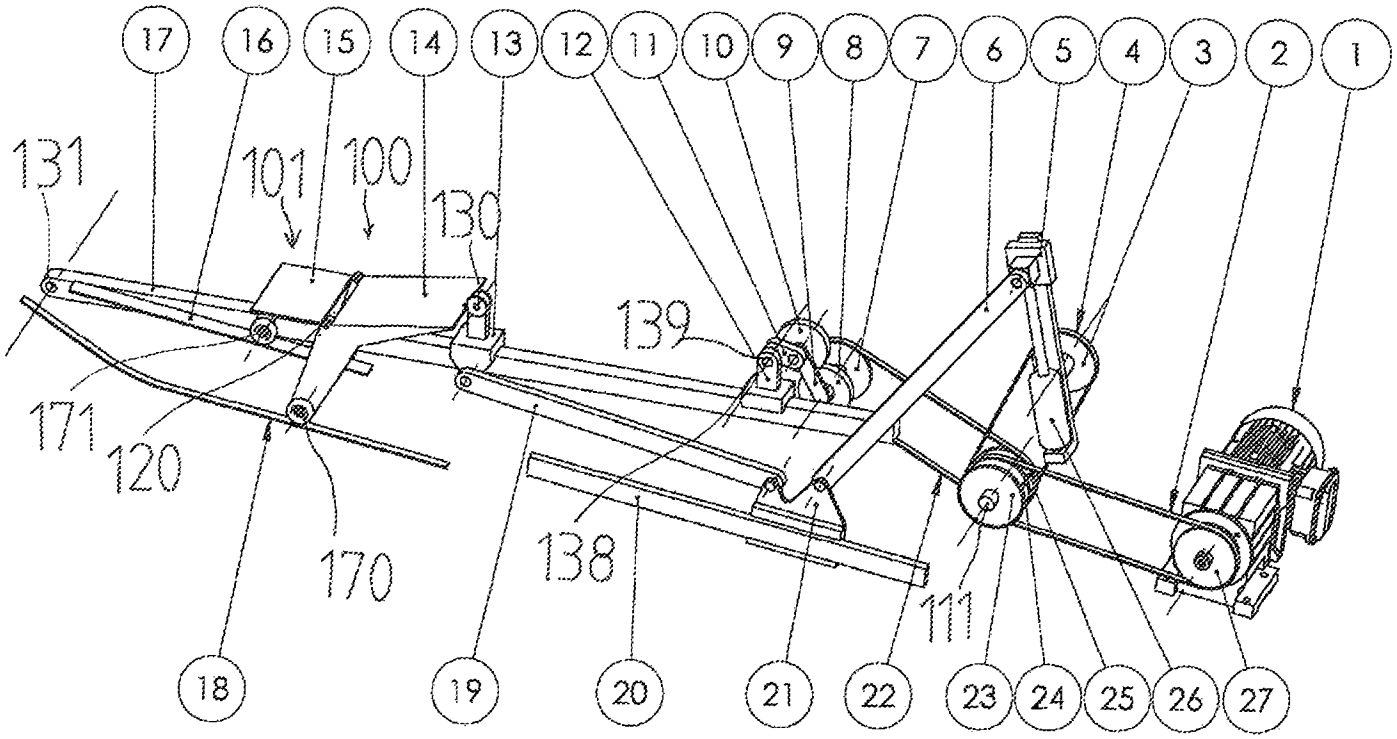
FIG. 1 is a perspective partial view of an embodiment of a device of the invention.

In the context of the present application, directions like "front" and "rear" are meant to be understood according to the walking direction.

Basically, mechanical elements, such as a chain, for example, can be replaced by equally functional elements known in the art, such as a belt.

FIGS. 1 through 5 show part of a walking movement device for producing a walking movement of a human being, who, while using the device, is suspended by a suspension unit (FIGS. 10, 11) for easing the weight, for example, by a carrying strap known as such, so that the human being's legs and feet do not have to carry off any load, or only a minor load, and the feet can be moved by the walking movement device for purposes of exercising or rehabilitation. However, using the walking movement device without a carrying strap or the like is also possible.

Movement of the feet is performed by two controlled foot guiding units 100, of which the left one is shown in FIGS. 1 through 5 as also representing the right one, which is mirror-symmetrical, each comprising a foot plate 101 for placing a foot thereon. For stimulation of the walking movement, the right and left foot plates 101 are alternately movable forward and backwards in opposite directions in a known manner.

According to this embodiment of the invention, the foot plates 101 each have a front and rear partial area 15, 14, wherein a drive unit 1 is provided, which is configured to move the rear partial area 14 out of the common plane with respect to the front partial area 15 and back again during the walking movement of the foot plates 101, in order to enable bending of the midfoot toe joint during the movement process.

Figure 2:
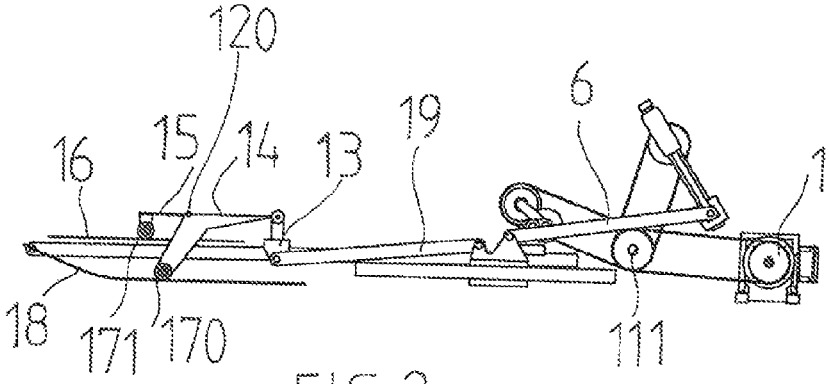
FIGS. 2 through 5 are side views of the device according to the embodiment of FIG. 1 in different phases of movement.
Figure 3:
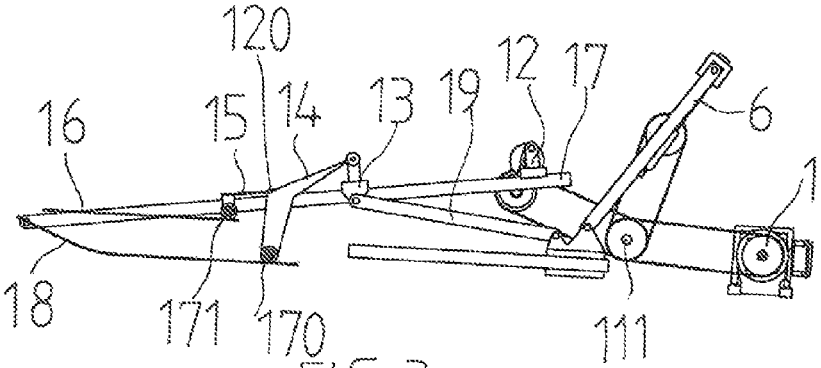

For this purpose, the rear end of the front partial area 15 and the front end of the rear partial area 14 of the foot plates 101 are joined together via a joint 120, the drive unit 1 being configured to pivot the rear partial area 14 of the foot plates 101 out of the common plane into an angular position with respect to the front partial area 15 and back again during the walking movement of the foot plates 101. FIG. 2 shows a position in which the rear and front partial areas 15, 14 are present in a common plane, and FIG. 3 shows a position in which the rear partial area 14 is pivoted off with respect to the front partial area.

The walking movement of the two foot plates 101 is effected by the drive unit 1, which comprises a horizontal drive unit and a vertical drive unit of the foot plate 101, the horizontal drive unit and the vertical drive unit, while being actuated by the one drive unit 1, still being independent of each other.

For this purpose, the drive unit 1, formed by an engine, actuates a gear or sprocket 27, which is coupled to another gear 24 via a chain 2, the other gear being supported on, and driving, a layshaft 111, which is itself coupled to a gear 3 via a gear 23 and a chain 4, the gear 3 driving a first eccentric drive unit 5, which is part of the horizontal drive unit, via a journal.

The horizontal drive unit further comprises a push rod 6 operated via the first eccentric drive unit 5 and another push rod 19 driven by the push rod 6, which is, at its operating end, coupled to the one foot plate 101 that is shown and which produces the horizontal movement.

One end of the other push rod 19 is hinged to a horizontal carriage 21 displaceable along a linear axis 20, which is moved back and forth due to the movement of the push rod 6, while the other end is hinged to a guide carriage 13, which is itself pivotably connected to the rear end of rear partial area 14.

The eccentric distance and/or the eccentric radius of the first eccentric drive 5 unit is continuously adjustable via an adjustment device 26, for example a belt drive unit or spindle drive unit, whereby the step range of the person can be adjusted.

The speed distribution between the standing-leg and free-leg phases of the foot, which is preferably 60:40, is achieved by an offset of the horizontal drive unit, i.e. a shifting between the axis of the eccentric drive unit 5 and the hinge point of the push rod 6 at the horizontal carriage 21.

The vertical drive unit, which is independent of the horizontal drive unit, is driven by the layshaft 111, which is driven by the engine 1 and itself drives a gear 25.

The vertical drive unit comprises a second eccentric drive unit 7, 8, 9, 10, 11 for each foot and a beam 17 coupled thereto and pivotable between a horizontal and an inclined position, a glidingly or rollingly supported guide carriage 13 being arranged on the beam, to which the operating end of the other push rod 19 is coupled, the guide carriage 13 itself being connected to the rear end of the rear partial area of the foot plate 101, 111 via a joint 130. In FIG. 1, only one beam 17, representing both feet, and the associated vertical drive unit are shown, while in the actual embodiment of the device of the invention, a total of two beams 17 is provided.

At the front end of the beam 17, a pivot bearing 131 is provided, via which the lifting and lowering movements of the beam 17 are performed. In the rear area of the beam 17, an eccentric movement carriage 12 is slidingly arranged, which converts the rotary movement of the second eccentric drive unit 7, 8, 9, 10, 11 to the lifting and lowering movements of the beam 17.

The second eccentric drive unit 7, 8, 9, 10, 11 is driven via the gear 25 arranged on the layshaft 111 and a chain 22, which is engaged in a gear or sprocket 7. Instead of the chain 22, a belt could also be provided—as a substitute for all other chains described herein. Via a first eccentric arm 9 and a gear 10 supported thereon, the gear 7 causes an unrolling movement along the outer circumference of a fixedly arranged gear 8, while the gear 10, in turn, rotatingly moves a second eccentric arm 11, which is rotatably supported in a pivot-bearing sleeve 139 arranged on the eccentric movement carriage 12 with the bearing pin 138 arranged at its outer end.

Using the second eccentric drive unit, periodic lifting and lowering of the beam 17 is achieved, wherein by lifting the beam 17, the rear partial area 14 of the foot plate 101 is pivoted upwards in order to allow the heel to be lifted with respect to the front foot, so that a natural bending movement of the foot can take place. In a lowered state of the beam 17, the rear partial area 14 of the foot plate 101 is also in a lowered state and in the same plane as the front partial area 15 of the foot plate 101.

As the second eccentric drive unit includes the eccentric movements of the first eccentric arm 9 and the second eccentric arm 11, it can be achieved that the time portion of the lowered state of the beam 17 is longer than that of the lifted state, in order to imitate the natural bending process of the foot, in which the bending sets in shortly before the lifting of the foot, which takes a shorter time than the previous time period, in which the bottom of the foot rests in a plane.

For this purpose, the first eccentric arm 9 circulates at the same angular speed as the eccentric drive unit 5 of the horizontal drive unit, while the second eccentric arm 11 circulates with twice that angular speed, which results in prolonged retention of the beam 17 in the lowered state.

The beam 17 remains in the low position for about three quarters of a rotation of the first eccentric arm 9, only to go up fast during the last quarter of the rotation and to then go back down again quickly.

The foot plate 101 is shiftably supported in the front, in the middle, and in the rear area in order to perform the back-and-forth movement of the foot plate 101 to achieve the movement process.

The front end of the rear partial area 14 of the foot plate 101 has two reels 170 spaced apart from one another transversely to the movement direction, which unroll on to parallel ramp lanes 18, only one of which is depicted in FIG. 1. The ramp lanes 18 are composed of a horizontal rear section and a linearly ascending front section.

Figure 5:
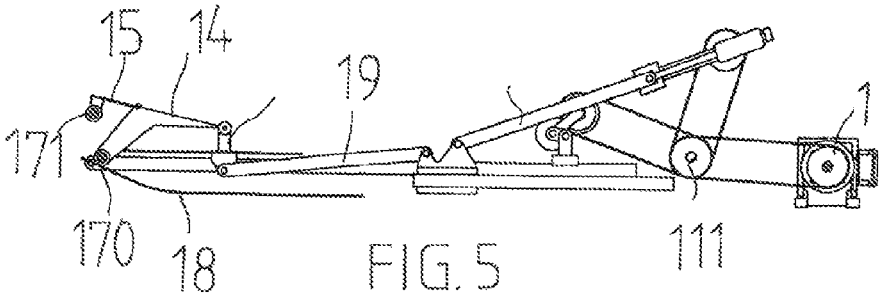

The front end of the front partial area 15 of the foot plate 101 has two rollers 171, only one of which is depicted in FIG. 1, which unroll on a horizontal section of a frame portion 16, the front partial area 15 of the foot plate 101 being moved with the rear partial area 14 at an angle with respect to the horizontal upon movement of the rear partial area of the foot plate 101 along the linearly ascending section 18 and the rollers 171 of the front partial area 15 being lifted from the horizontal section of the frame portion 16, while the reels 170 of the rear partial area 14 roll up the two ramp lanes 18. The front partial area 15 thereby abuts the rear partial area 14 and thus continues to be in a plane with the rear partial area even after being lifted. The end position of this movement is depicted in FIG. 5. The bottom of the foot rests in a plane on the front and rear partial areas 15, 14 and is directed upwards at an angle.

FIG. 3 shows the position in which the rollers 171 are located in the rear end area of the frame portion 16 and the rollers 170 are located in the rear end area of the ramp lanes 18, where at the same time, the beam 17 is in its lifted position via the second eccentric drive unit, whereby the rear partial area 14 is pivoted into an angular position with respect to the front partial area 15, which allows bending of the foot.

Figure 4:
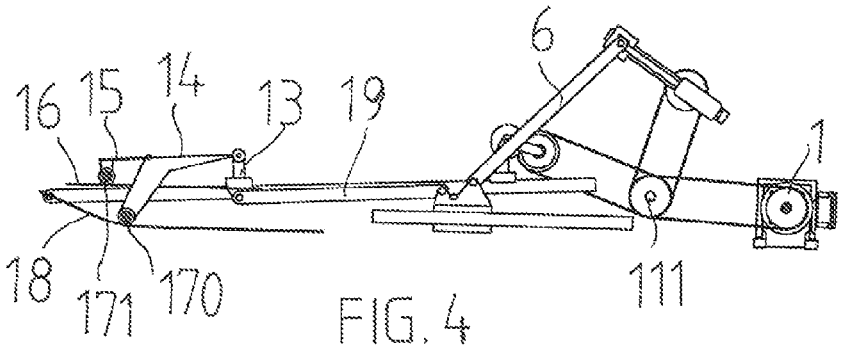

FIG. 2 and FIG. 4 depict positions of the foot plate 101, in which the bottom of the foot is entirely horizontal and rests in a plane on the same.

Figure 6:
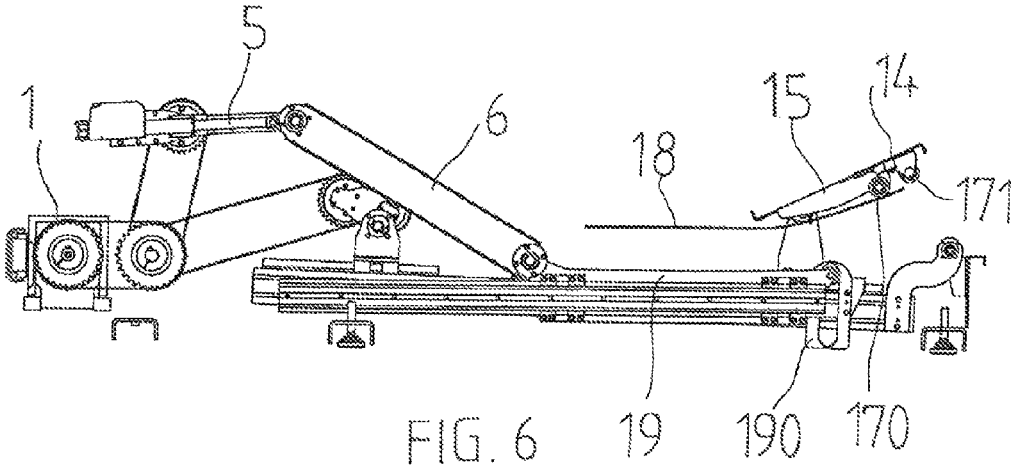
FIG. 6 is a side view of another embodiment of a device of the invention.
Figure 7:
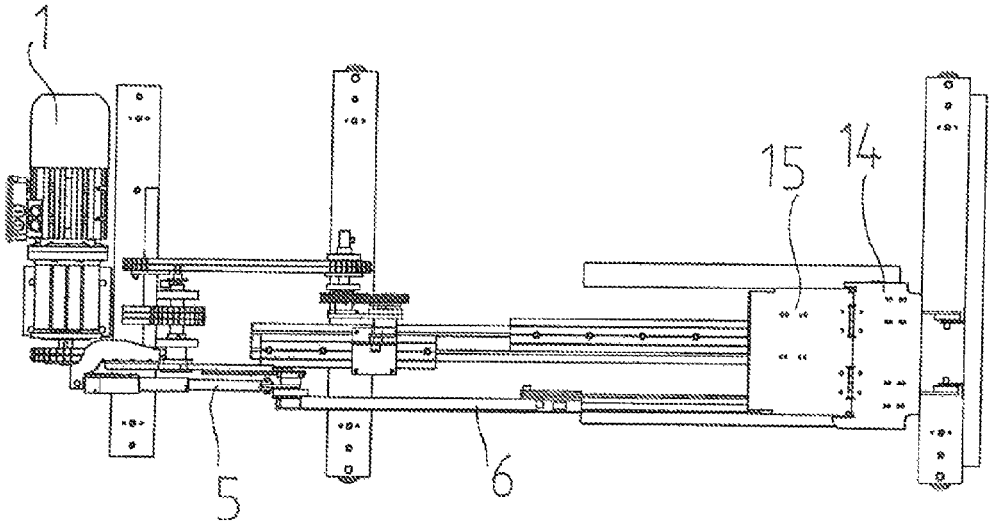
FIG. 7 is a top view of the device of FIG. 6.

FIGS. 6 and 7 show another exemplary embodiment, in which again only half of the device, for one foot, is shown. The other push rod 19 is guided horizontally, and as a compensation for the upwards movement, a gliding template 190 is formed, which compensates during the movement for the periodically appearing difference in level between the front and rear partial areas of the foot plate 15, 14, which is caused by the vertical drive unit.

Figure 8:
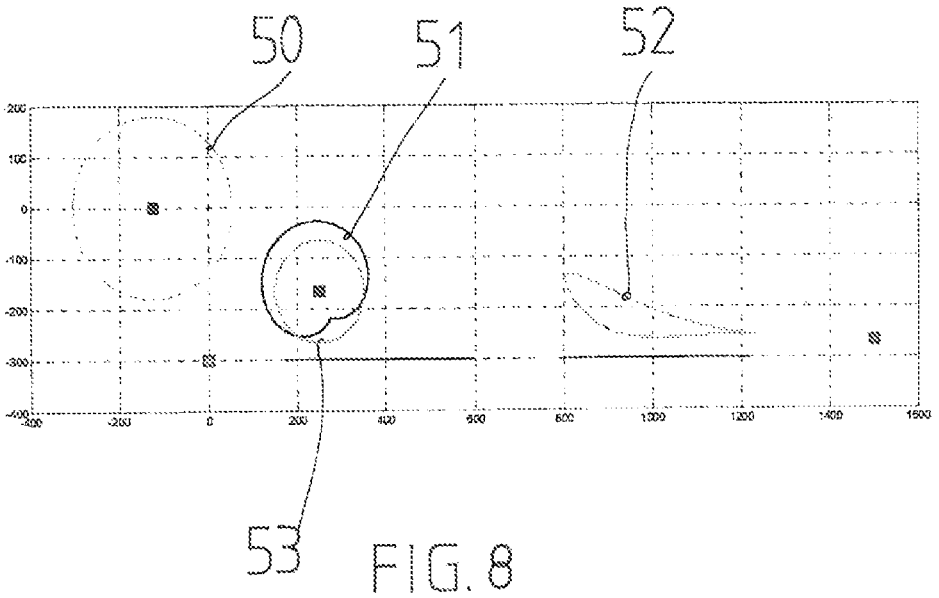
FIG. 8 is a graphical illustration of movement schemes of the drive unit, the vertical drive unit and the foot plate of the device of the embodiment according to FIGS. 1 to 5.

FIG. 8 shows a movement curve 50 of the points in the device of the invention that move in a circular manner, an equally circular movement curve 53 at the drive unit side of the eccentric unit of the vertical drive unit, and a movement curve 51 occurring at the output side, as well as a movement curve 52 of the rear partial area 14 of the foot plate 101. The movement curve 52 corresponds to the movement of the heel. The movement curves 53 and 51 are parts of the vertical drive unit, the movement curve 53 being generated by the gear 10 unrolling along the outer circumference of the gear 8, whereby the beam 17 is periodically lifted and lowered and the rear partial area 14 of the foot plate 101 being pivoted upwards as the beam 17 is lifted and then lowered again, from which the movement curve 52 results for the rear partial area 14.

Figure 9:
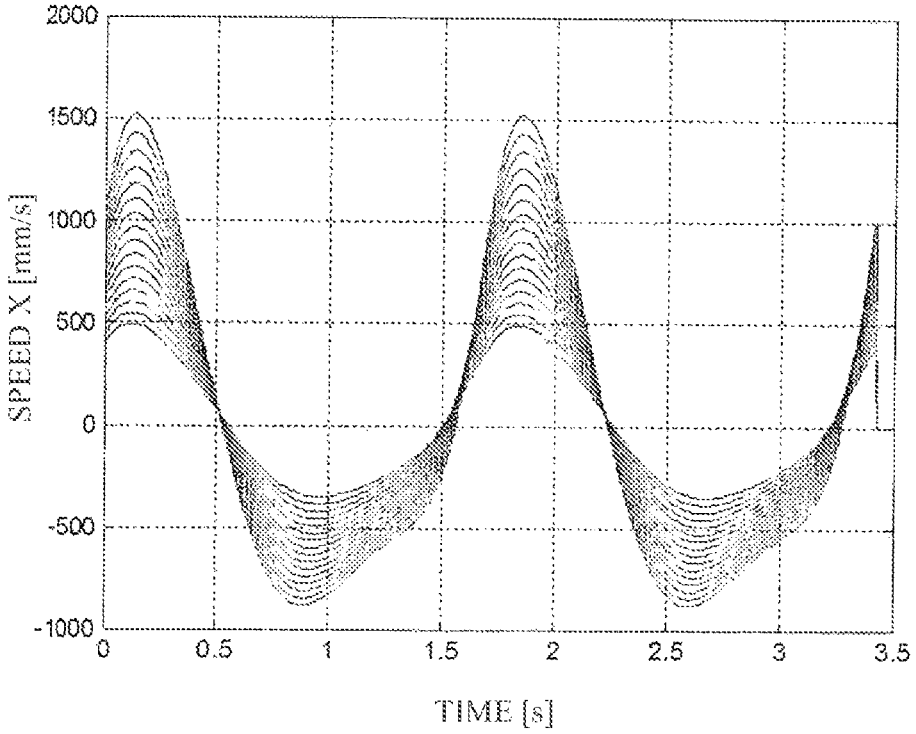
FIG. 9 is a graphical illustration showing speed schemes of the horizontal movement of the foot plate of the device of the embodiment according to FIGS. 1 to 5.

FIG. 9 shows the course of the horizontal speed of the foot plate 101 at different step ranges and at a constant step frequency, the positive speed values being associated with the free-leg phase and the negative speed values being associated with the standing-leg phase. The speed distribution equals about 60:40.

Figure 10:
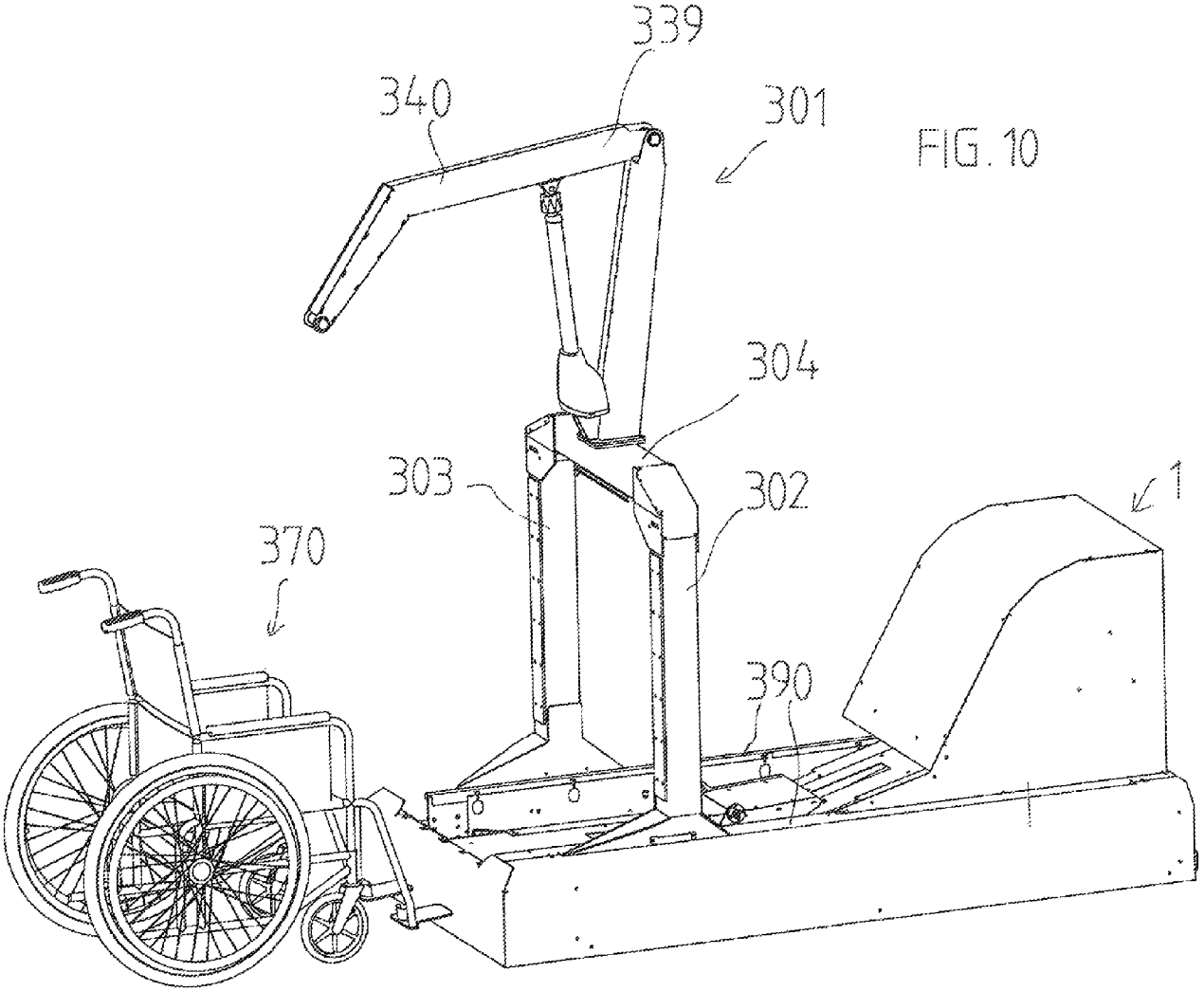
FIG. 10 is a perspective view of another embodiment of the device of the invention having a suspension unit in a loading/unloading position.
Figure 11:
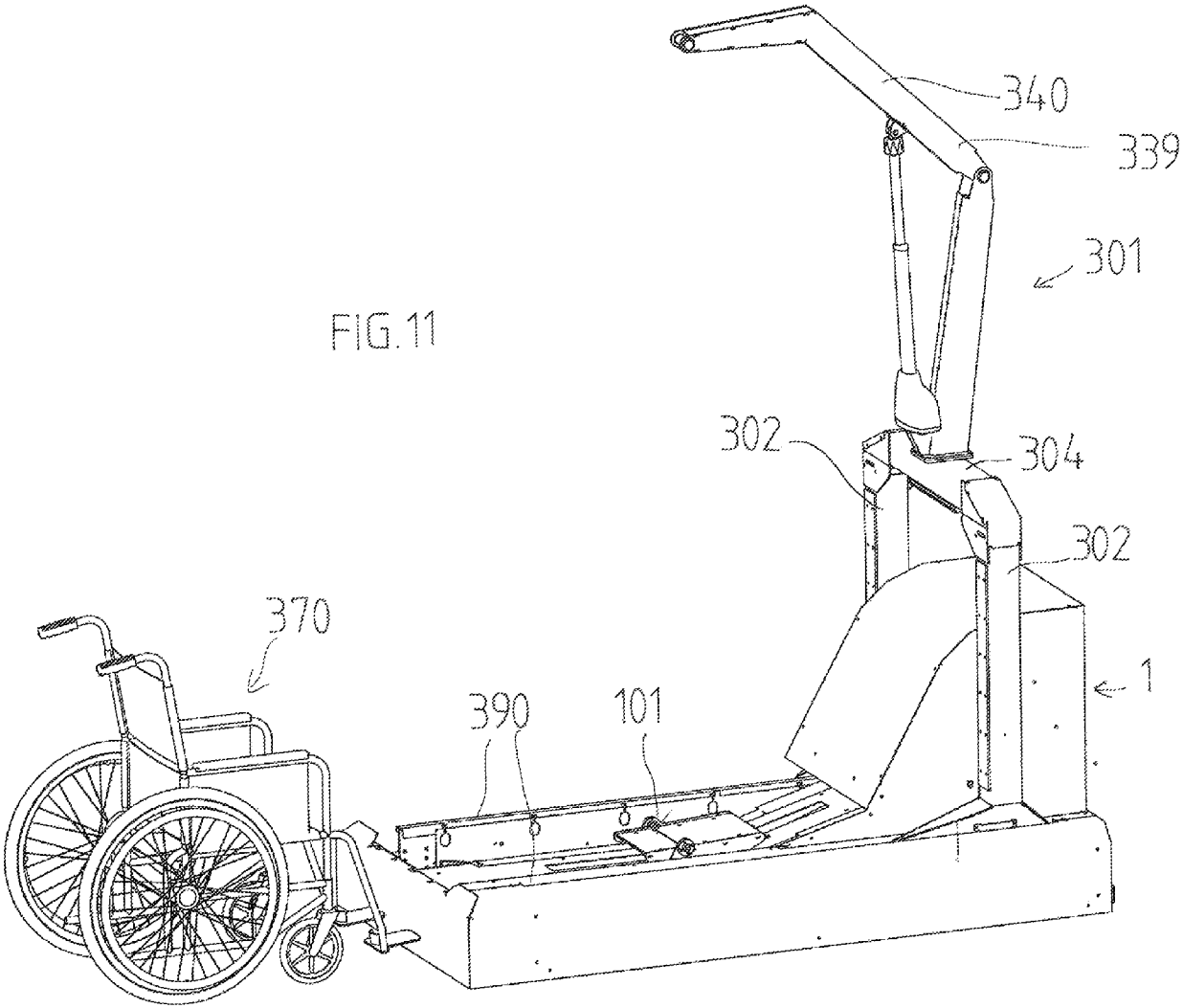
FIG. 11 is a view of the embodiment of FIG. 10 in an operating position.

FIG. 10 shows a device of the invention having a suspension unit 301, which comprises two lateral standing legs 302 and 303 connected to each other via a cross-bar 304, on which an electro-mechanical crane unit 339 having an adjustable crane arm 340 is arranged, with which a person (not shown here) can be lifted from a wheelchair 370. At the bottom side, the lateral standing legs 302, 303 are shiftably supported in respective lateral rails 390, so that the lifted person can be transferred from a loading or unloading position into a working position, as shown in FIG. 11, in which the adjustable crane arm 340 is lifted and the person heaved into a standing position to fix the person's feet onto the foot plates 101 so that these can be actuated by the drive unit 1 in order to let the person perform a walking movement.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A walking movement device for producing a walking movement of a human, the device comprising two controlled foot guiding units, each foot guiding unit comprising a foot plate configured for placing a foot thereon, the foot plates being alternately movable forward and backwards in opposite directions to stimulate the walking movement, and the foot plates being coupled with at least one drive unit to produce the walking movement of the foot plates, and a suspension unit configured for easing weight on the human, wherein the foot plates each have a front and a rear partial area, a front end of the rear partial area of the foot plate having rollers which unroll on ramp lanes, which are composed of a rear horizontal section and a front ascending section, and the at least one drive unit being configured to move the rear partial area out of a common plane with respect to the front partial area and back again during the walking movement of the foot plates, thereby being adapted to enable bending of the midfoot toe joint of the human during the walking movement.

2. The walking movement device of claim 1, wherein a rear end of the front partial area and the front end of the rear partial area of the foot plates are joined together via a joint, the at least one drive unit being configured to pivot the rear partial area of the foot plates out of the common plane into an angular position with respect to the front partial area and back again during the walking movement of the foot plates.

3. A walking movement device for producing a walking movement of a human, the device comprising:

two controlled foot guiding units, each foot guiding unit comprising a foot plate configured for placing a foot thereon, the foot plates being alternately movable forward and backwards in opposite directions to stimulate the walking movement, and the foot plates each having a front and a rear partial area, a rear end of the front partial area and a front end of the rear partial area of the foot plates being joined together via a joint, the foot plates also being coupled with at least one drive unit to produce the walking movement of the foot plates, the at least one drive unit comprising a horizontal drive unit and a vertical drive unit of the foot plates, the drive units being formed independently of each other, the horizontal drive unit of the foot plates comprising a first push rod operated via a first eccentric drive unit and a second push rod driven by the first push rod and coupled to the foot plates at its operating end, the at least one drive unit being configured to pivot the rear partial area of the foot plates out of a common plane with respect to the front partial area into an angular position with respect to the front partial area and back again during the walking movement of the foot plates, thereby being adapted to enable bending of the midfoot toe joint of the human during the walking movement, and a suspension unit configured for easing weight on the human.

4. The walking movement device of claim 3, wherein the vertical drive unit comprises a second eccentric drive unit for vertical actuation and a beam coupled thereto and pivotable between a horizontal position and an inclined position, a glidingly or rollingly supported guide carriage being arranged on the beam, to which the operating end of the second push rod is coupled, and the guide carriage itself being connected to a rear end of the rear partial area of the foot plate via a joint.

5. The walking movement device of claim 4, wherein the second eccentric drive unit for vertical actuation comprises a first eccentric arm and a second eccentric arm driven by the first eccentric arm, the second eccentric arm rotating at an angular speed that is twice an angular speed of the first eccentric arm.

6. A walking movement device for producing a walking movement of a human, the device comprising:

two controlled foot guiding units, each foot guiding unit comprising a foot plate configured for placing a foot thereon, the foot plates being alternately movable forward and backwards in opposite directions to stimulate the walking movement, wherein the foot plates each have a front and a rear partial area, a front end of the front partial area of the foot plate having rollers which unroll on a horizontal section of a frame portion, the front partial area of the foot plate being moved with the rear partial area at an angle with respect to the horizontal, upon movement of the rear partial area of the foot plate along a linearly ascending section, and the rollers of the front partial area being lifted from the horizontal section of the frame portion while rollers of the rear partial area roll up the ramp lanes, the foot plates also being coupled with at least one drive unit to produce the walking movement of the foot plates, the at least one drive unit being configured to move the rear partial area out of a common plane with respect to the front partial area and back again during the walking movement of the foot plates, thereby being adapted to enable bending of the midfoot toe joint of the human during the walking movement, and a suspension unit configured for easing weight on the human.

7. The walking movement device of claim 3, wherein the horizontal drive unit and the vertical drive unit are driven via a common engine.

8. The walking movement device of claim 7, wherein the suspension unit comprises a controllable crane arm and is horizontally movable in order to carry the human being in and/or out.

9. The walking movement device of claim 1, wherein the foot plates are coupled to a vibration unit, which generates a vibration of the foot plates.

* * * * *